United States Patent [19]

Arnold

[11] 4,418,435

[45] Dec. 6, 1983

[54] CARBON BUTT CLEANING APPARATUS AND METHOD

[75] Inventor: J. Edgar Arnold, Summerville, S.C.

[73] Assignee: Alumax, Inc., San Mateo, Calif.

[21] Appl. No.: 360,454

[22] Filed: Mar. 22, 1982

[51] Int. Cl.[3] ..... B08B 1/02

[52] U.S. Cl. ..... 15/4; 15/89; 15/93 R

[58] Field of Search ..... 15/3, 4, 93 R, 89, 91; 134/6

[56] References Cited

U.S. PATENT DOCUMENTS 1,741,959 12/1929 Speck et al. ..... 15/89

3,224,022 12/1965 Kehr ..... 15/4

*Primary Examiner*—Edward L. Roberts

*Attorney, Agent, or Firm*—Philip M. Shaw, Jr.

[57] ABSTRACT

A method and apparatus for cleaning cryolite from spent anodes comprising an overhead spent anode transport which carries the spent anodes through a series of four processing stations, with the first processing station loosening the cryolite by means of a plurality of slide mounted jackhammers, the second processing station scraping off the loosened cryolite by means of a plurality of scraper blades carried on chains, a a third station at which the cryolite between the support rod posts is knocked loose by still another set of jackhammers, and a fourth station at which the topmost side surfaces of the spent anode are wire brushed free of any remaining cryolite.

10 Claims, 12 Drawing Figures

CARBON BUTT CLEANING APPARATUS AND METHOD

BACKGROUND OF THE INVENTION

This invention relates to the cleaning of spent anodes from an aluminum processing plant and, more particularly, to a method and apparatus for automatically cleaning the cryolite from such spent anodes.

In the aluminum industry, carbon anodes are used during the production of aluminum. The anodes are lowered into a reduction cell during the process of producing the primary aluminum. Cryolite and alumina are heaped into the cell during the process. Throughout the course of the production of the aluminum, the carbon anode is eroded away until only a stub is left. This stub is constituted of a carbon butt mounted on a vertical rod which joins the butt at two or more iron posts embedded in the carbon. During the course of aluminum production, a coating of cryolite builds up over the carbon butt and the end of the support rod and posts.

Heretofore this covering of cryolite has been removed manually using jackhammers and sledge hammers. The cleaning of each butt has required a considerable amount of man hours and, because of the dust and noise involved, has presented serious health safety problems and environmental problems which have been costly to overcome. Furthermore, the cleaning of the butts is a bottle neck in the overall aluminum production process because, until the rods are cleaned, they cannot be returned to the anode shop for refitting in new carbon anodes.

SUMMARY OF THE INVENTION

The above and other problems of prior art carbon butt cleaning procedure are overcome by the present invention of apparatus for cleaning cryolite from spent anodes which comprises a plurality of automatic processing stations and overhead transportation means for automatically transporting separate spent anodes from and through each such processing station. At the first processing station, first jackhammer means break the cryolite covering loose from the top side surfaces of each anode as it passes through the station. At a second station, rotary scraper means scrape off the loosened cryolite. In the preferred embodiment, the rotary scraper means comprise a pair of rotary chains having scraper blades attached thereto which are lowered into place and which scrape the top side surfaces longitudinally with respect to the spent anode. Thus, the cryolite is loosened and scraped off of the top side surfaces of the anode at the first two processing stations.

At a third processing station, a second jackhammer means knocks the remaining cryolite from the top center surface of each anode, that is between the support posts attached to the rod. At a fourth processing station, rotary wire brushes take off the bulk of the remaining loosened cryolite from each anode.

In the preferred embodiment, the jackhammer means at the first station comprise a pair of jackhammers on one side of the anode and a single jackhammer, centered between the pair of jackhammers on the opposite side of the anode. The jackhammers are mounted at predetermined acute angles with respect to the top side surfaces of the anode to be cleaned. The jackhammers extend their blades, in succession, into contact with the anode as it passes through the first station. The jackhammers are automatically activated as they contact the anode.

At the second processing station, the rotary scraper means are pivoted to raise their leading edges up and out of contact with the anode as it first enters the station. The automatic transport means stops the anode and locks it in place as the rotary scraper blades are pivotally lowered to make contact with the top side surfaces. After a predetermined portion of the top side surfaces have been scraped of loose cryolite, the anode is allowed to travel further into the processing station so that the remaining top side portions of the anode can be scraped. This procedure effectively allows the scraper means to scrape off the surfaces in manageable "bites" rather than becoming jammed by trying to scrape the entire surface at once.

At the third processing station, a pair of jackhammers are mounted to travel horizontally to impinge upon the cryolite covering between the support posts attached to the support rod. The anode butts up against an anvil plate which stops the swinging movement of the anode as the jackhammers pound away the cryolite from between the posts. The anvil is pivoted to allow the loosened cryolite to pass underneath it and to prevent the anode from "hanging" on the anvil plate.

It is therefore an object of the present invention to provide apparatus for automatically cleaning the cryolite coating from spent anodes in an aluminum production process.

It is another object of the invention to provide means for automatically loosening the cryolite covering from a spent anode.

It is yet another object of the invention to provide means for automatically scraping loosened cryolite from the surface of a spent anode.

It is yet a further object of the invention to provide means for automatically breaking off the cryolite coating which exists between the support rod posts of a spent anode.

It is still another object of the invention to provide means for automatically wire brushing loosened cryolite from a spent anode.

The novel features which are believed to be characteristic of the invention, both as to organization and method of operation, together with further advantages thereof, will be better understood from the following drawings, in which several preferred embodiments of the invention are illustrated by way of example.

DETAILED DESCRIPTION OF THE PREFERRED EMBODIMENT

Figures 1, 2, 3:
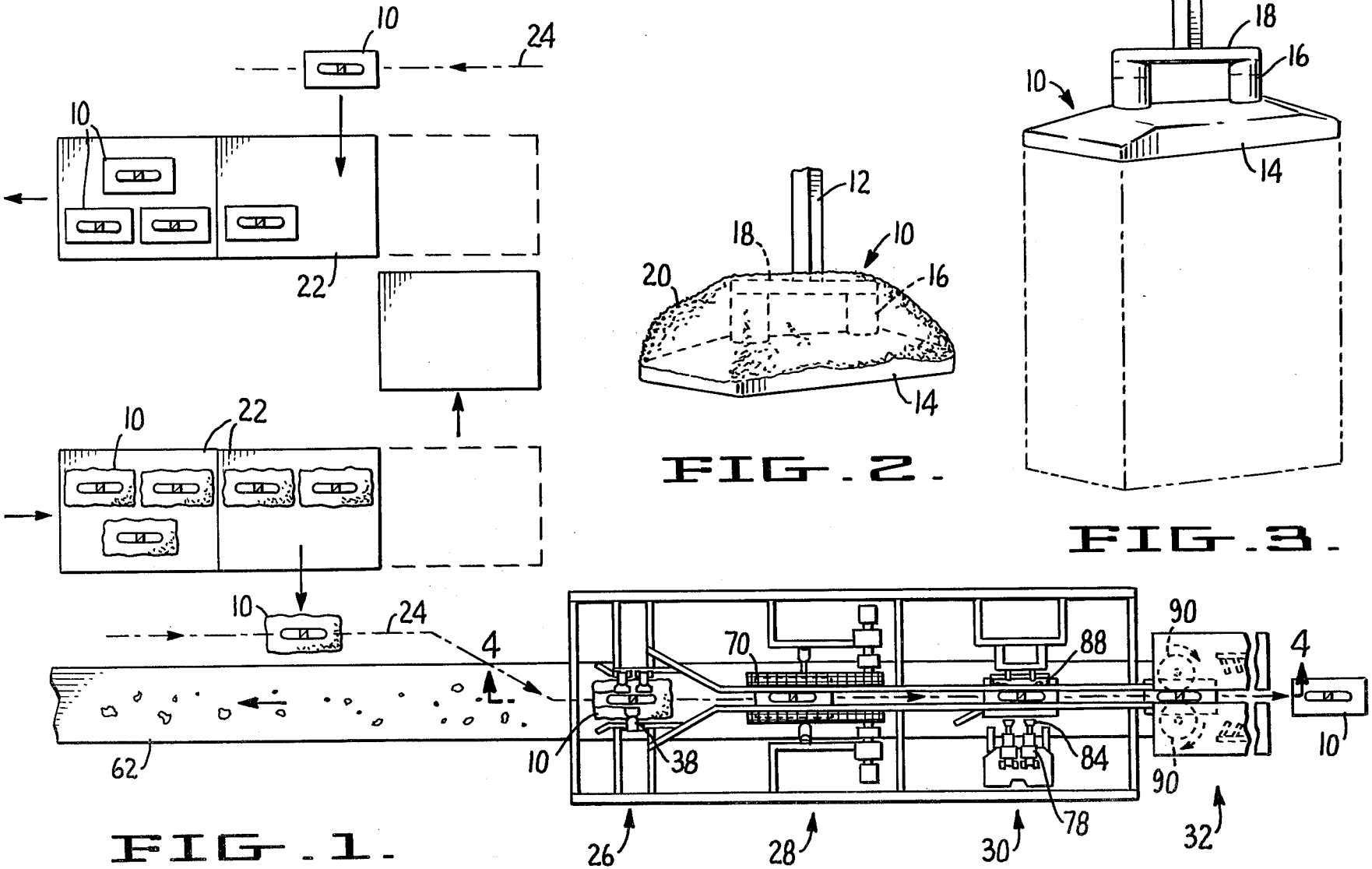
FIG. 1 is a diagrammatic plan view illustrating a portion of the spent anode cleaning apparatus and method of the present invention.
FIG. 2 is an enlarged, perspective view of a spent anode prior to cleaning.
FIG. 3 is an enlarged, perspective view of a spent anode after cleaning and also illustrating, in dash-line fashion, the size of the anode prior to its erosion during the production of primary aluminum.

Referring now more particularly to FIGS. 1, 2 and 3, a spent anode which is to be processed according to the method and apparatus of the invention is comprised of a vertical support rod 12 which is attached to the carbon butt 14 through a pair of iron posts 16 which are embedded in the carbon butt. Posts 16 are attached to the rod 12 by means of a horizontal bar 18 which spans the top of the posts 16. While the invention hereinafter to be described is primarily concerned with the cleaning of carbon butts supported by this type of arrangement, in other types of aluminum production, different configurations of support rods and posts are utilized for supporting one or more carbon butts in a cluster. In order to clean such different configurations, adaptations of the apparatus hereinafter described will necessarily have to be made.

As illustrated in FIG. 3 in dashed line fashion, the butt 14 after many hours of use in the primary cell is eroded from an elongated block into a short butt. As shown in FIG. 2, this butt is covered with a layer of cryolite 20 which must be removed prior to crushing the carbon butt 14 free of the posts 16.

In the carbon butt cleaning section of the processing plant the spent carbon butts 10 which are covered with a coating of cryolite 20 are placed on rail mounted pallets 22 in groups of three. Each spent anode 10 is lifted up and placed in engagement with an overhead conveyor, shown diagrammatically at line 24 in FIG. 1, which clasps the top of the support rod 12 so that the support rod 12 and spent anode 10 hang beneath it and travel along the chain conveyor 24. Since such conveyors are well-known and are conventional in the carbon butt reprocessing industry, they will not be described in greater detail. The overhead conveyor 24 carries each spent anode or butt through a series of processing stations comprised of a first jackhammer station 26 which loosens the cryolite, a scraper station 28 which scrapes off the loosened cryolite from the top side surfaces of a spent anode, a processing station 30 which utilizes a pair of jackhammers to knock off the loosened cryolite from between the posts 16 and a processing station 32 which uses wire brushes to clean the top side surfaces of the spent anode.

Trip switches (not shown) at the entrance and the exit of the processing stations 26, 28, 30 and 32 prevent the anodes from entering a processing station before the anode, which is currently being processed in that station, is finished. These switches cause the overhead transportation means to disengage that particular anode as it enters the processing station until work at that station has been completed whereupon the anode support rod 12 is again engaged with the overhead transportation means 24 to travel into the appropriate processing station.

A conventional process controller (not shown) operates the various processing stations according to a predetermined timed sequence.

After leaving the wire brushing station 32, the butt appears as it does in FIG. 3. The butt thereafter can be selectively blasted with shot to clean any remaining cryolite. The cleaned butt is placed in a crusher (not shown) which breaks the carbon butt 14 free from the posts 16. The crushed carbon is ground up and reused in making new anodes. This crushing process is all conventional and is not part of the present invention and is, therefore, not shown in the figures. The new anodes are returned via an overhead conveyor 24 and placed on an empty pallet 22 as illustrated in the upper portion of FIG. 1.

Figure 4:
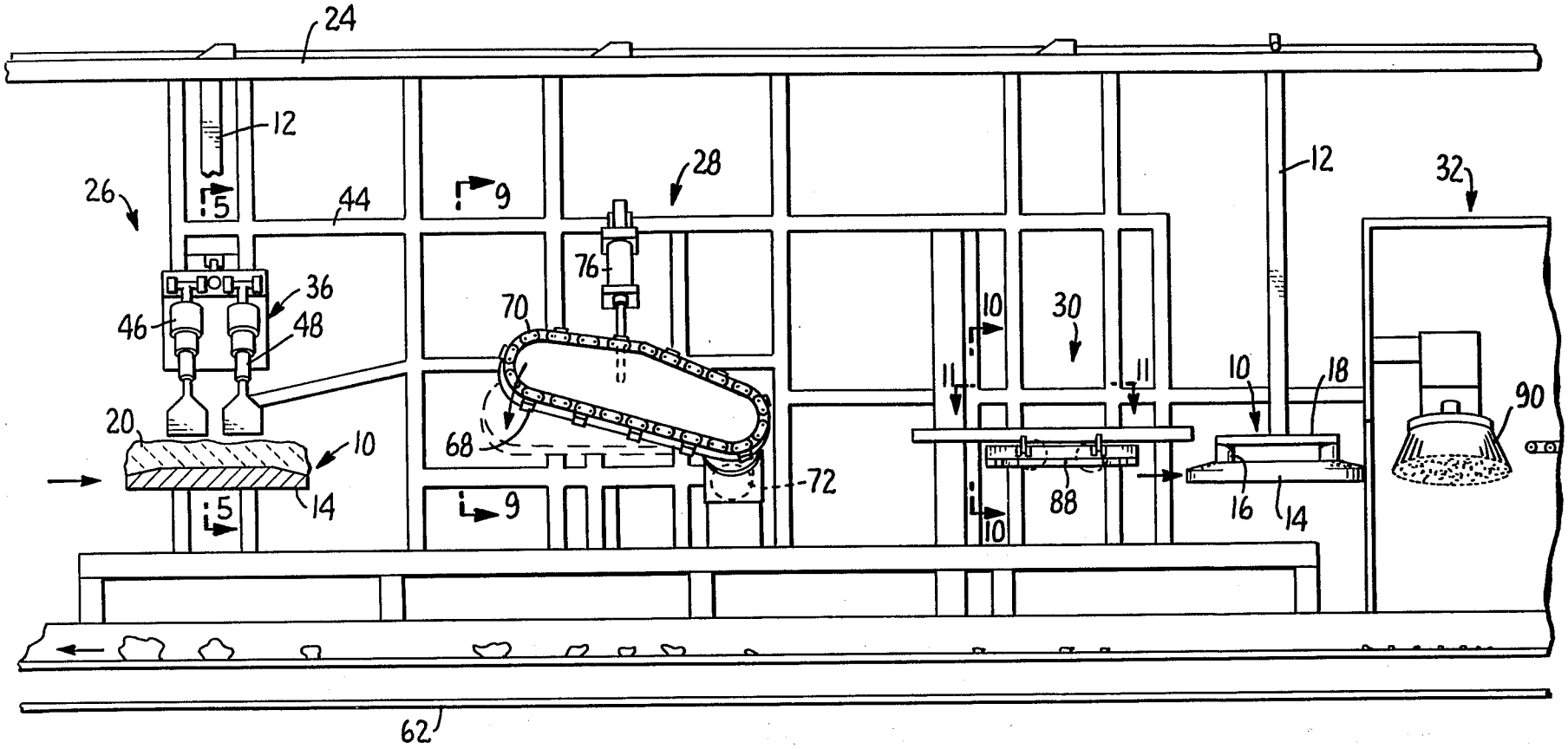
FIG. 4 is an enlarged, vertical, sectional view, taken generally the lines 4—4 of FIG. 1, with portions broken away.

Referring now more particularly to FIG. 4, the processing stations 26 through 32 are illustrated in greater detail. The spent anode 10, drawn by the conveyor 24 into the first processing station 26, encounters a first jackhammer means 36. As best viewed in FIGS. 5 and 6, the first jackhammer means 36 is comprised of a first jackhammer 38 mounted on a slide plate 40 which is extendable by means of an air cylinder 42. The slide plate 40 and the air cylinder 42 are mounted on a frame structure 44.

The slide plate 40 mounts the jackhammer 38 at a predetermined acute angle with respect to the top side surfaces of the butt 14. Opposite to the jackhammer 38 are mounted a pair of jackhammers 46 and 48. The jackhammers 46 and 48 are also mounted an a slide plate 50 which is extendable by means of an air cylinder 52. The slide plate 50 and the air cylinder 52 are also mounted on a frame 44. The slide plate 50 mounts the jackhammers 46 and 48 at a predetermined acute angle with respect to the top side surface of the butt 14. This angle is between 15° and 25° and in the preferred embodiment is 20°. The jackhammers are held on the slide plates 40 by means of grips 54 which encircle the handles 56 of the respective jackhammers.

The grips 54 also are aligned to press upon the jackhammer trigger 58 when the jackhammer blade encounters resistance. Thus, in operation, the slide plates 40 and 50 lower the jackhammers 38, 46 and 48 into engagement with the cryolite coating on the spent anode 14 to the point where the jackhammers are lifted up in the holders 54 until their respective triggers 58 are operated to cause the jackhammers to begin operation. In the preferred embodiment, the sequence is that the jackhammers 46 and 48 are lowered about 3 seconds ahead of the jackhammer 38. This causes the anode to swing over towards the jackhammer 38. When all jackhammers are lowered and engaging the spent anode, they will eventually stop just short of the top surface of the spent anode 14. This swinging action causes the jackhammer blades to loosen the cryolite coating 20 along the entire top side surfaces of the anode 14.

Figure 7:
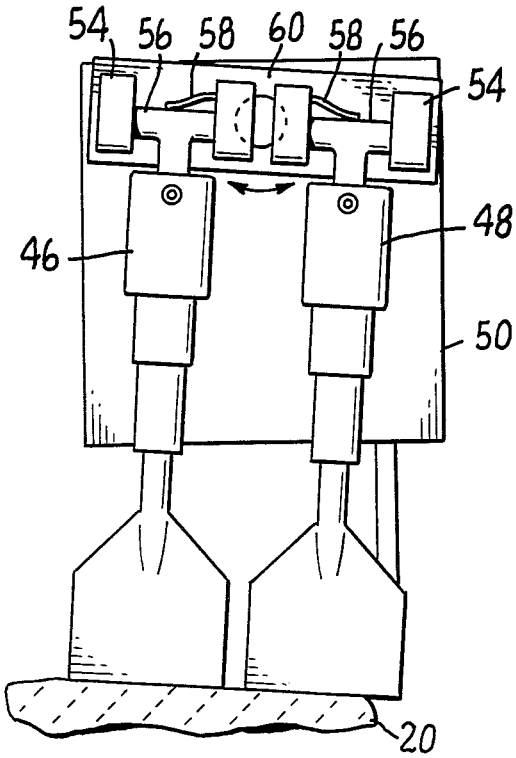
FIG. 7 is a vertical view, with portions broken away, taken generally along the lines 7—7 in FIG. 5.
Figure 8:
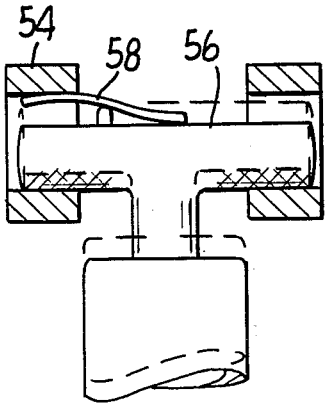
FIG. 8 is an enlarged, vertical view, partly in section and with portions broken away, taken generally along the lines 8—8 in FIG. 5.

Referring now more particularly to FIG. 7, it can be seen that the jackhammers 46 and 48, through the handle grips 54, are mounted on a swivel plate 60 which is pivotally mounted to the slide plate 50 such that the jackhammers 46 and 48 can pivot in a plane which includes both jackhammers and which is parallel to the slide plate 50. This allows the jackhammers to operate over uneven surfaces where a bending torque would otherwise be produced to break the jackhammers free of the slide plate or to break the slide plate mechanism. It also helps prevent uneven stresses being placed on the jackhammer blades themselves which would otherwise cause them to break.

Figure 5:
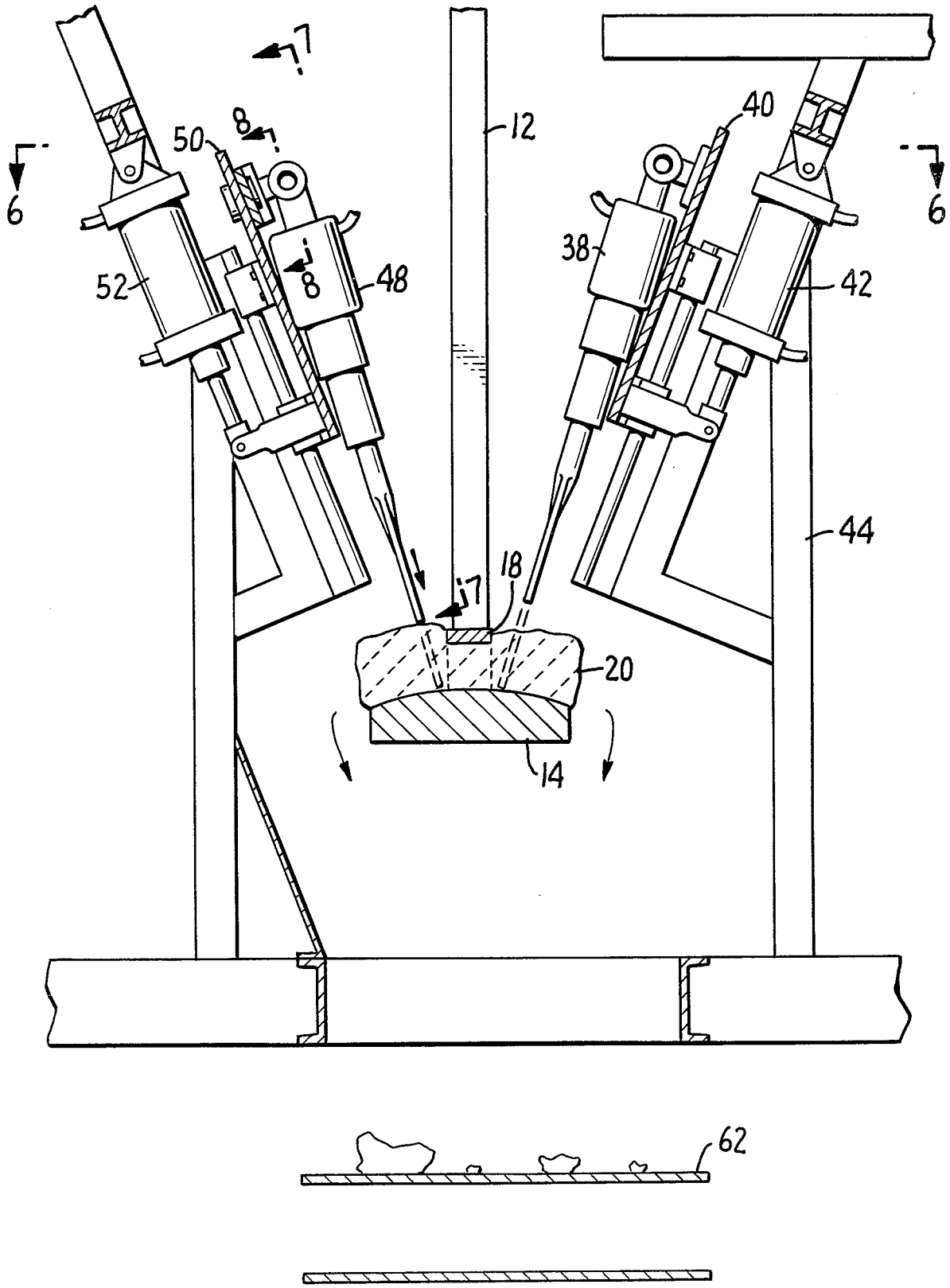
FIG. 5 is a vertical, sectional view, with portions broken away, taken generally along the lines 5—5 in FIG. 4.
Figure 6:
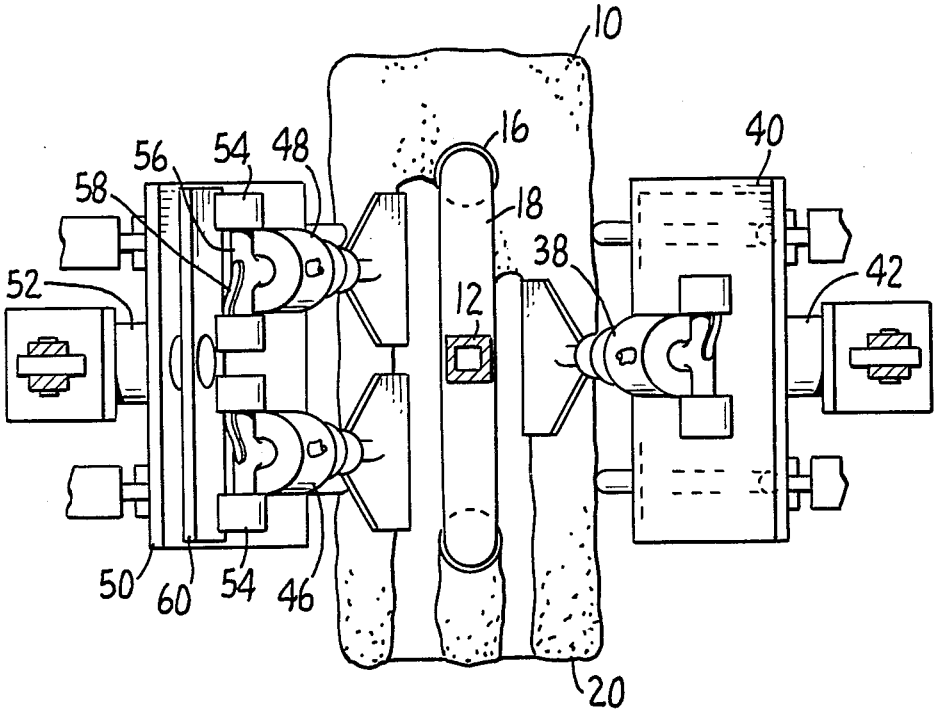
FIG. 6 is a top view, with portions broken away and in section, taken generally along the line 6—6 in FIG. 5.

As best shown in FIGS. 4 and 5, the loosened cryolite which falls from the spent anode 14 drops onto a moving conveyor 62 which takes the cryolite material away for reprocessing and/or disposal.

Figure 9:
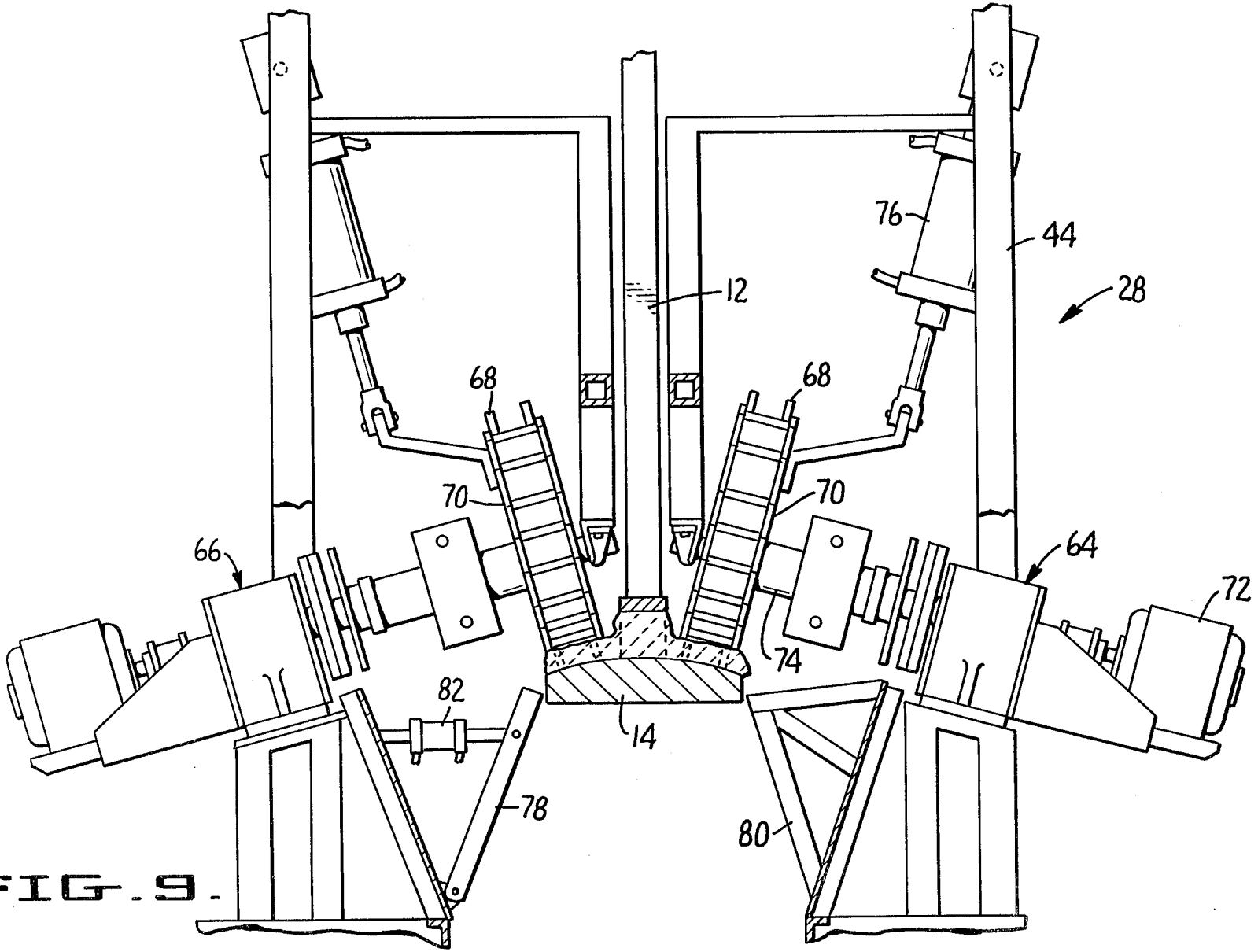
FIG. 9 is a vertical, sectional view, with portions broken away, taken generally along the lines 9—9 in FIG. 4.

Referring now more particularly to FIG. 9, the second processing station 28 is illustrated in greater detail. At this station, a pair of rotary scraping devices 64 and 66 scrape the cryolite loosened at the first station off of the top side surfaces of the anode 14. Each of the scrapers 64 and 66 is comprised of a plurality of scraper blades 68 which are mounted on a chain 70. The chain 70 is driven by means of an electric motor 72 connected to chain 70 through a drive shaft 74. The chain mechanism 70 can be pivoted about the axis of the shaft 74 by means of lift cylinders 76 mounted on the frame 44, as best illustrated in FIG. 4. The arrangement of the drive shaft 74 and the chain 70 is such that the leading end of the chain 70, taken with respect to the direction of travel of the anode can be lifted up and over the anode 14 as it enters the second processing station 28. The lift cylinder 76 then lowers the chain scrapers into engagement with the top side surfaces of the spent anode 14 to scrape away the cryolite loosened at the first station. The shaft 74 is aligned to be approximately parallel with the topside surfaces of the anode 14.

If the rotary scraping devices 64 and 66 were lowered on the entire top side surface of the anode 14 at once, they would probably jam since there would be too much material to scrape away at one time. In order to prevent this from happening, the anode is scraped in stages. The overhead transportation means 24 brings the anode into the second processing station 28 until a predetermined portion of the top side surface of the spent anode 14 lies beneath the rotary scrapers 64 and 66. The anode is then automatically disengaged from the overhead transportation means 24 and is held in place by a movable stop 78 which squeezes the sides of the anode 14 between the stop 78 and a back plate 80. A hydraulic or pneumatic cylinder 82 operates the stop plate 78. The stop plate 78 and the back plate 80 are attached to frame 44.

Figure 11:
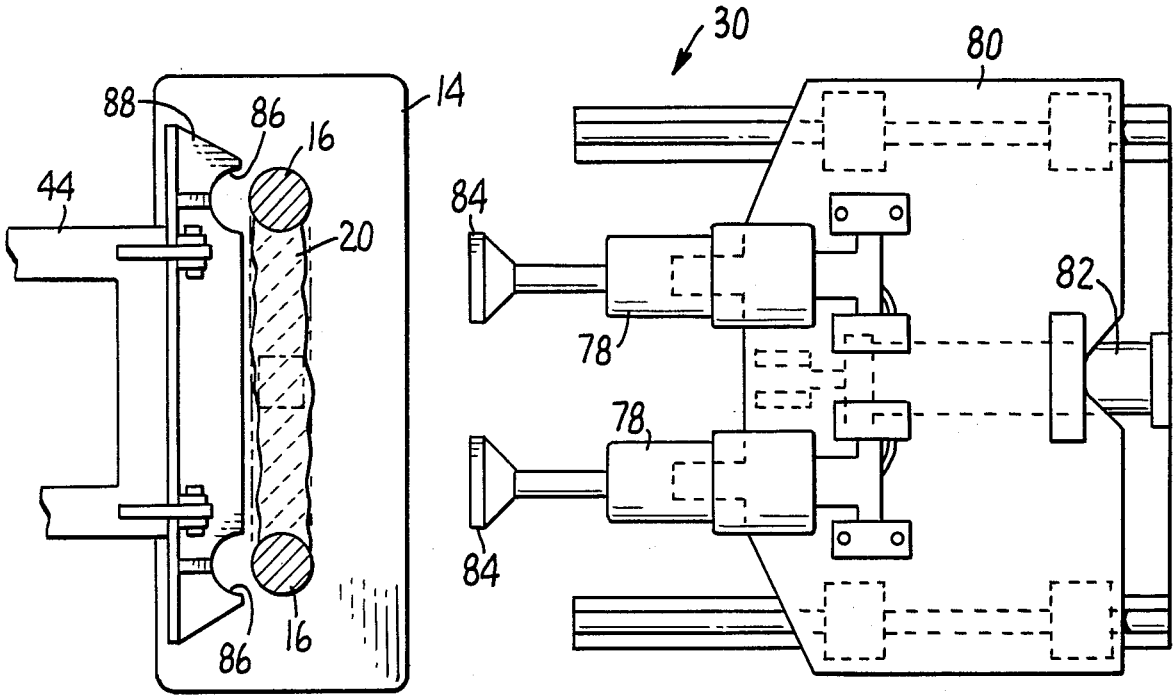
FIG. 11 is a top, plan view, with portions broken away, taken generally along the lines 11—11 in FIG. 4.
Figure 10:
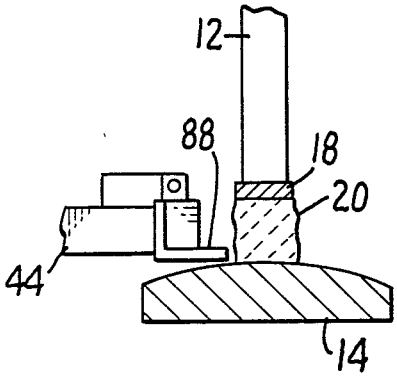
FIG. 10 is a vertical, sectional view, with portions broken away, taken generally along the lines 10—10 in FIG. 4.
Figure 12:
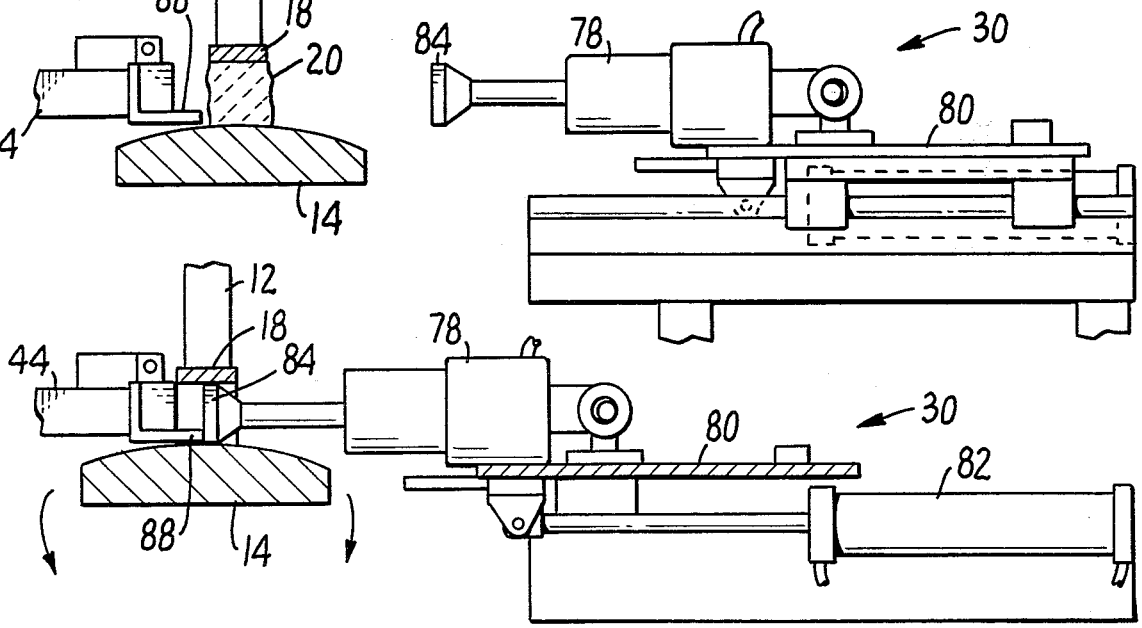
FIG. 12 is a vertical, sectional view, with portions broken away, corresponding to FIG. 10, showing the operation of the second jack hammer means at the third processing station.

Referring now more particularly to FIGS. 10, 11 and 12, the operation of the third processing station 30 will be described in greater detail. After leaving the processing station 28, the spent anode has most of the cryolite coating 20 removed, except that portion which lies between the two posts 16 which connect to the horizontal bar 18. In order to remove this material, a pair of jackhammers 78 are mounted by their handles on a horizontal slide plate 80 which is driven by an air cylinder 82 to extend outward from the frame 44 and to engage the coating 20 above the topmost surface of the anode 14 between the posts 16, as best illustrated in FIG. 12. Like the jackhammers 38, 46 and 48, the jackhammers 78 are automatically activated upon engagement with the portion of the cryolite coating 20 between the posts 16. The jackhammers are equipped with blunted, flat blades 84.

When the blades 84 engage the cryolite 20, the anode 14 is swung away from the jackhammer 78 until the posts 16 engage the notches 86 of an anvil plate 88 which is pivoted to the frame 44. The debris are allowed to pass both under and over the anvil plate and the anvil plate will not hang on the anode surface 14 when the jackhammers 78 are withdrawn.

After the anode leaves the processing station 30, it is brushed clean by a pair of electric motor driven, rotating wire brushes 90 at the processing station 32. The brushes 90 both rotate in the same direction so that no net driving force is imparted to the anode 14 as it hangs by the support rod 12.

As is apparent in FIGS. 1 and 4, the conveyor 62 extends beneath all of the processing stations to carry away debris. As previously mentioned, the control of the various jackhammers, scrapers and rotary brushes is done by means of a master process controller operating on a timed sequence basis and in conjunction with actuators and sensors at the various processing stations which sense and control the positions of the anodes as they pass through the processing stations. Since such apparatus is well-known to those skilled in the art, it will not be described in greater detail.

The terms and expressions which have been employed here are used as terms of description and not of limitation and there is no intention, in the use of such terms and expressions, of excluding equivalents of the features shown and described, or portions thereof, it being recognized that various modifications are possible within the scope of the invention as claimed.

What is claimed is:

1. Apparatus for cleaning cryolite from spent anodes comprising a plurality of automatic processing stations, overhead transportion means for automatically transporting separate spent anodes from and through each such station, first jackhammer means at a first one of the processing stations for breaking the cryolite loose from the top side surfaces of each anode passing through the station, rotary scraper means at a second one of the processing stations for scraping off cryolite loosened at the first station, second jackhammer means at a third one of the processing stations for knocking cryolite from the center of the top surface of each anode passing through the third station and rotating brush means at a fourth one of the processing stations for brushing loosened cryolite from each anode passing through the fourth station.

2. Apparatus as recited in claim 1 wherein the first jackhammer means comprises a first jackhammer on one side of the anode to be cleaned, a second jackhammer on the opposite side of the anode to be cleaned, means for mounting the jackhammers at predetermined acute angles to the top side surfaces of the anode to be cleaned and for extending the jackhammers, in succession, into contact with the anode present at the first station.

3. Apparatus as recited in claim 2 further comprising means for automatically activating the jackhammers when they contact the anode.

4. Apparatus as recited in claim 2 wherein the first jackhammer means further includes a third jackhammer mounted immediately adjacent to the second jackhammer, the second and third jackhammers being operable as a pair, and wherein the mounting means includes a pivoted frame to allow the second and third jackhammers to pivot from side to side in a plane which intersects both of said jackhammers.

5. Apparatus as recited in claim 4 wherein the rotary scraper means further includes means for pivotably mounting the rotating chains to pivot about axes perpendicular to the line of travel of the anode through the second station such that the end of the scraper chain nearest the anode entrance of the second station can be lifted above the incoming anode to be scraped.

6. Apparatus as recited in claim 4 wherein the scraper blades have scraping edges which are parallel to the top side surfaces of the anode to be cleaned at the second station.

7. Apparatus as recited in claim 4 wherein the overhead transportation means positions the anode to be scraped at the second station in a first position, which exposes a first portion of its top side surface to the scraper blades, for a predetermined period of time and then advances the anode to a second position which exposes the remaining portion of the anode's top side surfaces to the scraper blades.

8. Apparatus as recited in claim 1 wherein the rotary scraper means comprises a plurality of scraper blades carried on a pair of rotating chains mounted to extend longitudinally along opposite, top side surfaces of the anode.

9. Apparatus as recited in claim 1 wherein the second jackhammer means, at the third station, comprises a pair of side by side jackhammers slidably mounted for horizontal travel to engage the cryolite on the topmost surface of the anode, an anvil plate mounted on the opposite side of the anode from the second jackhammer means to brace the anode against the force of the second jackhammer means.

10. Apparatus as recited in claim 9 wherein the anvil plate is pivotable upwardly with respect to the topmost surface of the anode to allow the cleaned debris to pass underneath it.

* * * * *